US008316768B2

(12) United States Patent
Reistroffer

(10) Patent No.: US 8,316,768 B2
(45) Date of Patent: Nov. 27, 2012

(54) LINEAR INCENDIARY STRAND AND METHOD FOR PRESCRIBED FIRE IGNITION

(76) Inventor: Jeffrey P. Reistroffer, Plains, MT (US)

( * ) Notice: Subject to any disclaimer, the term of this patent is extended or adjusted under 35 U.S.C. 154(b) by 757 days.

(21) Appl. No.: 10/597,346

(22) PCT Filed: Feb. 1, 2005

(86) PCT No.: PCT/US2005/003302

§ 371 (c)(1),
(2), (4) Date: Aug. 23, 2006

(87) PCT Pub. No.: WO2005/033202

PCT Pub. Date: Oct. 13, 2005

(65) Prior Publication Data

US 2009/0272288 A1 Nov. 5, 2009

Related U.S. Application Data

(60) Provisional application No. 60/542,377, filed on Feb. 6, 2004.

(51) Int. Cl.
*F42D 3/00* (2006.01)

(52) U.S. Cl. ..... 102/302; 102/275.6; 102/275.11

(58) Field of Classification Search ..... 102/302, 102/360, 275.6, 275.8, 275.9, 275.11, 277.1; 169/28, 35, 36
See application file for complete search history.

(56) References Cited

U.S. PATENT DOCUMENTS 1,693,818 A * 12/1928 Reihlen ..... 102/360
3,263,613 A * 8/1966 Rice et al. ..... 60/255
3,402,032 A * 9/1968 Schick ..... 44/558
3,697,668 A * 10/1972 Campbell ..... 327/525
3,712,222 A * 1/1973 Richardson et al. ..... 102/275.1
3,751,954 A * 8/1973 Ezra et al. ..... 72/56
3,793,100 A * 2/1974 Fronabarger ..... 149/77
3,830,156 A 8/1974 Sewell et al.
4,025,369 A 5/1977 Price et al.
4,220,087 A * 9/1980 Posson ..... 102/275.6
4,402,270 A * 9/1983 McCaffrey ..... 102/275.3
4,938,293 A 7/1990 Warren et al.
5,293,859 A 3/1994 Lisker
5,384,238 A * 1/1995 Ellis et al. ..... 430/617
5,894,891 A 4/1999 Rosenstock et al.
5,976,293 A * 11/1999 Olander et al. ..... 156/172
5,983,886 A 11/1999 Allbeck
6,152,010 A 11/2000 Mixon et al.
6,460,535 B1 10/2002 Nisewander et al.
6,511,520 B1 * 1/2003 Eber et al. ..... 44/388
RE38,592 E * 9/2004 Wu et al. ..... 102/352
7,097,203 B2 * 8/2006 Burns et al. ..... 280/741
2001/0030006 A1 10/2001 Fischer et al.

* cited by examiner

*Primary Examiner* — Stephen M Johnson

(57) ABSTRACT

An elongate, flexible, incendiary device for producing a nearly instantaneous source of flaming combustion along a linear pathway of indeterminate length. The incendiary device is provided in the form of a solid, continuous strand, such as, for example, a ribbon, tape, cord, filament, rope or tube. The device is comprised of means for rapid ignition along the longitudinal axis of the strand in co-linear arrangement with a solid or semi-solid combustible fuel composition. Upon ignition, the device produces flames from its exterior surface for a duration of time suitable for igniting nearby combustible matter. The incendiary device provides a nearly instantaneous line of fire for igniting prescribed fires, controlled burns, and backfires. A method for igniting vegetative matter over an area of land using one or more indeterminate lengths of a rapidly igniting linear incendiary strand.

15 Claims, 3 Drawing Sheets

LINEAR INCENDIARY STRAND AND METHOD FOR PRESCRIBED FIRE IGNITION

CROSS-REFERENCE TO RELATED APPLICATION

This application claims priority back to U.S. Application No. 60/542,377, which was filed on 6 Feb. 2004.

STATEMENT REGARDING FEDERALLY SPONSORED RESEARCH OR DEVELOPMENT

This invention is based upon work supported by the Cooperative State Research, Education, and Extension Service, U.S. Department of Agriculture, under Grant No. 2003-33610-13068. The federal government has certain rights in the invention.

BACKGROUND OF THE INVENTION

1. Field of the Invention

This invention relates to incendiary devices and methods used to initiate fires, more specifically, for the purpose of igniting prescribed fires in forest and range land vegetation.

2. Description of the Related Art

Prescribed burning refers to the deliberate application of fire to wildlands to achieve specific resource management objectives. It involves the tasks of planning, igniting and controlling the fire. Known fire behavior models are used to determine the range of weather conditions that will permit accomplishment of sufficient fuel reduction goals, while still allowing personnel to maintain control of the fire. Burning operations can only be conducted when fuel moistures are within a specified range, and weather conditions must be ideal in order to produce a desirable level of fuels reduction with minimal risk of fire escape. Air quality is a significant concern, which may limit the time frames available for conducting burn projects. Limited available personnel and limited funding further hamper the ability of resource management personnel to meet their prescribed burning goals.

The two operational phases of prescribed burning are the ignition phase and the holding phase. The holding phase involves controlling a fire that has been set, and this phase is highly dependent on the availability of manpower and equipment. The present invention relates to the ignition phase. Currently, there are two primary means of ignition: aerial ignition and ground ignition. Aerial ignition involves the use of helicopters to fly over the intended burn area and dispense either incendiary plastic spheres (as in U.S. Pat. No. 4,422,383) or a trail of flaming, gelled gasoline (as in U.S. Pat. No. 4,247,281). Helicopter use is very costly and requires a number of ground support personnel; however, it is the preferred method for treating large burn areas. There is a higher level of risk to personnel involved with aerial operations, and there is a limit to the level of precision that can be achieved with aerial ignition.

Handheld drip-torches, which have been used for decades, are the predominate tool used for ground ignition. This method involves personnel walking across unburned fuels, in sequential strips through the burn unit, while dispensing a flaming diesel/gasoline mix. Depending on vegetation conditions, this process can be extremely time-consuming or, alternatively, may require a significant number of ground personnel. Crew safety is also an obvious concern, as personnel are setting fire to materials through which they are walking. In short, the primary method of igniting natural fuels, whether by aerial or ground means, is the application of flaming petroleum products to the natural fuels.

By contrast, the present invention involves an improved method for the ignition of natural vegetative fuels that does not rely on the application of flaming petroleum products. Instead, the present invention is a filamentous incendiary material that will ignite rapidly and sustain sufficient flaming combustion for the ignition of forest fuels.

The prior art includes a number of patents and published applications directed toward various methods of igniting fires, but none of these inventions possess the unique attributes of the present invention, which are more fully described below. Much of the prior art relates to fuses, which are distinguishable from the present invention. A fuse is defined generally as a core of readily combustible material that is lighted at one end to carry a flame along its length to detonate an explosive at the other end. Whereas a fuse works to transmit a signal (or flame) along its path from one point to another, the present invention is intended to ignite quickly (nearly instantaneously along its length) and sustain flaming combustion for a period of time sufficient to ignite wood, grass, straw, needles, moss, and any other type of fuel that is in close proximity along the length of the strand of the present invention.

The prior art also includes deflagrating cords that ignite instantaneously and provide a short-lived flash of heat sufficient to ignite a rocket motor or vehicle air bag deployment charge. Unlike the present invention, these deflagrating cords do not provide the duration of flaming combustion necessary to light vegetative materials that may have a high moisture content. For this reason, the deflagrating cords that have been described in previous patent applications are not as effective as the present invention in igniting forest vegetation.

There are several examples of the fuse-type ignition method. U.S. Publication No. 2002018941 (Smith, 2002) discloses a linear ignition fuse with a shaped sheath that creates gas channels along the length of the fuse; U.S. Pat. No. 4,220,087 (Posson, 1980) describes a linear ignition fuse with a gas channel that extends longitudinally; and U.S. Pat. No. 5,540,154 (Wilcox et al., 1996) provides a linear ignition fuse with an elongated core of non-detonating ignitive material, a longitudinally extending gas channel, a frangible sheath of inorganic material surrounding the core and the channel, and a jacket of braided filaments encasing the sheath. U.S. Pat. No. 5,540,155 (Hill, 1996) relates to an elongate flexible fuse made of an oxidizing agent and a fuel present in quantities that allow for a rate of burning of from 10 seconds/meter to 250 seconds/meter.

There are also a number of patents that cover deflagrating cords. Some examples are: U.S. Pat. No. 3,320,882 (Schulz, 1967), which discloses an igniter cord consisting of a high explosive compound and a particulate metal enclosed in a metal sheath, for use in connection with propellant charges and rocket ignition; U.S. Pat. No. 5,322,018 (Hadden et al., 1994), which describes a surface-initiating deflagrating material consisting of a pyrotechnic material and an inorganic binder, such as silica, carried on a carrier web preferably made of fiberglass and with a hollow core; and U.S. Pat. No. 3,367,266 (Griffith, 1968), which relates to a detonating and deflagrating fuse that has a wrapper of flexible material enclosing a cracked and discontinuous column of solid explosive.

Several patents have attempted to deal with the specific problems associated with fire ignition for the purpose of agricultural practices, forest management, or amelioration of environmental contamination. U.S. Pat. No. 4,256,086 (Collett et al., 1981) covers a method for rapidly igniting combustible material over a predetermined area of a field. Simply put, this method involves attaching combustible elements to a line and advancing the line across the field. U.S. Pat. No. 4,247,281 (McGrew et al., 1981) describes a method of "slash burning" whereby a helicopter carries a dispenser with a jelly-like mixture of aluma gel and gasoline, and the mixture is ignited and dropped on the area to be burned. U.S. Pat. No. 5,429,494 (Kuehn, 1995) discloses a transportable ignition device adapted for use in forestry management practices and consisting of a fuel storage tank and a pressurizing assembly. The fuel is expelled from an application wand, ignited, and delivered to a distant target by virtue of the pressurized pump. U.S. Pat. No. 4,422,383 (Couture et al., 1983) relates to a floating incendiary device that is dropped from an aircraft onto a combustible material on a body of water. The device includes an incendiary composition that is sandwiched between a pair of discs that direct the resulting flame radially outwardly over the surface of the combustible material. The latter invention was intended to provide a method for dealing with hydrocarbon slicks that float on water and adversely affect the marine environment. U.S. Pat. No. 6,128,845 (Jacobson, 2000) relates to a fire starting flare for hand-held launchers that allows brush fires to be started remotely from the person controlling the device. The flare projectile of the invention has a range of one hundred thirty yards and emits a shower of sparks over the immediate vicinity of where it lands.

The main object of the present invention is to provide a method of igniting fires for the management of forest vegetation that is much safer for fire management personnel than the primary method currently employed, which entails dispensing flaming petroleum while walking through the area to be burned. A further object of the present invention is to provide a method for fire ignition that is more effective in igniting forest vegetation than the fuse- or deflagrating cord-type methods described above.

BRIEF SUMMARY OF THE INVENTION

Generally, the present invention provides an elongate, flexible, incendiary device for producing a nearly instantaneous source of flaming combustion along a linear pathway of indeterminate length. the subject incendiary device is provided in the form of a solid, continuous strand, such as, for example, a ribbon, tape, cord, filament, rope or tube. The device is comprised of means for rapid ignition along the longitudinal axis of the strand in co-linear arrangement with a solid or semi-solid combustible fuel composition. Upon ignition, the device produces flames from its exterior surface for a duration of time suitable for igniting nearby combustible matter. The incendiary device of the present invention essentially provides a nearly instantaneous line of fire for igniting prescribed fires, controlled burns, and backfires.

The present invention's ability to generate the flaming combustion necessary for igniting forest or agricultural vegetative fuels along a linear pathway, nearly instantaneously, distinguishes it from other prior art devices. Present devices for providing rapid linear ignition include linear ignition fuses, pyrotechnic quick match, and deflagration cord. These devices provide an intense, momentary flame rapidly along their lengths, but they do not provide the sustained flame generation required for igniting nearby woody materials.

The present invention further provides a method for igniting vegetative matter over an area of land using one or more indeterminate lengths of a rapidly igniting linear incendiary strand. The strand(s) is/are placed upon the surface of the area of land to be burned, and then ignited in a manner that provides for the burning of the vegetative materials according to desired fire behavior aspects. The present invention is particularly well suited for the prescribed burning of forest and rangeland vegetation, and it is also suitable for use in the controlled burning of agricultural field residues.

In accordance with one aspect of the invention, the incendiary device is a solid elongate strand of indeterminate length possessing a degree of flexibility allowing it to be wound upon a spool for handheld deployment across an area of land.

In accordance with another aspect of the invention, the linear incendiary device is provided with weatherproofing features enabling the device to be deployed in the area to be burned days or weeks prior to ignition.

In accordance with another aspect of the invention, the linear incendiary device may be ignited by direct flame contact, such as from a match, or may be remotely initiated by electrical means.

In accordance with another aspect of the invention, the linear incendiary device is provided with means to cause the separation of the strand into individually burning fragments shortly after ignition. This feature is advantageous if the strand is draped over branches or other debris, and flame contact with surface fuels is desired to ensure a contiguous line of fire.

In accordance with another aspect of the invention, the linear incendiary device is comprised of materials derived from renewable resources, and provides a substitute for the petroleum-based products now used for igniting prescribed fires.

In accordance with yet another aspect of the invention, the method of igniting fires using a linear incendiary strand provides improved means to control and manipulate fire behavior, and also provides a greater degree of safety for burn personnel.

DETAILED DESCRIPTION OF THE INVENTION

Figure 1:
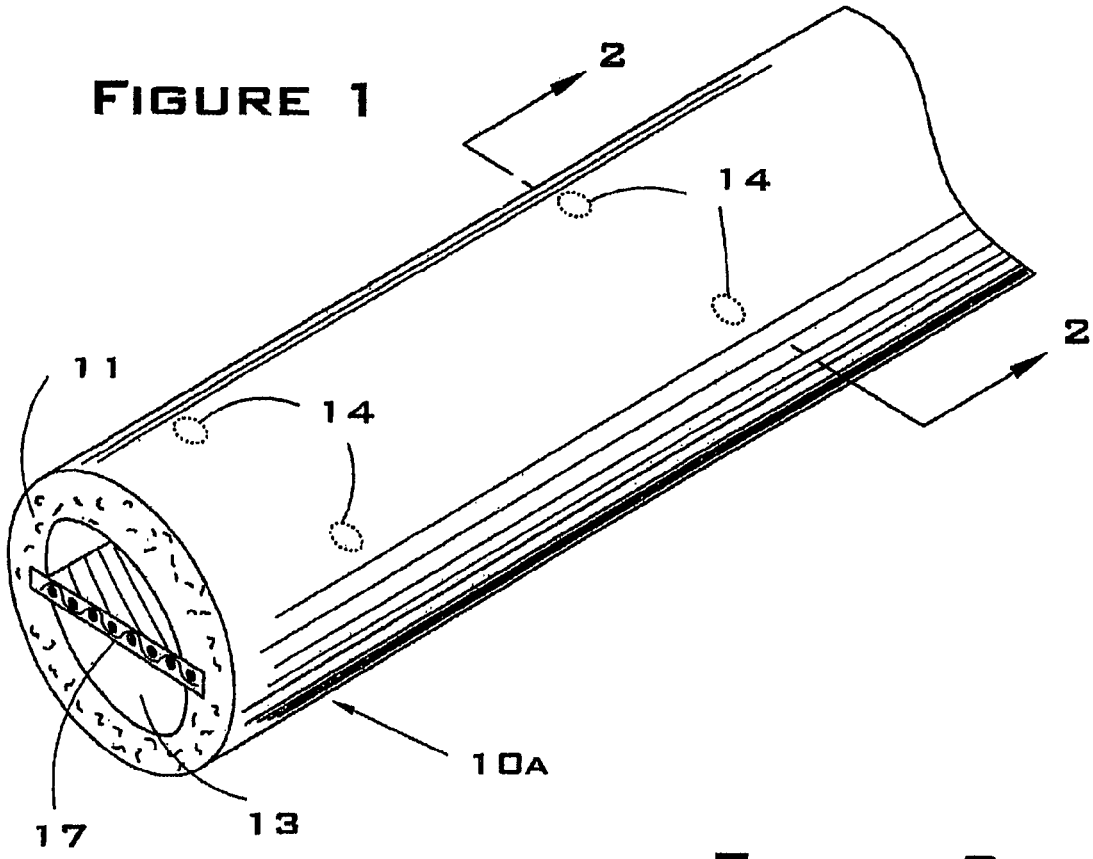
FIG. 1 is a fragmentary isometric view of a cord-like embodiment of a linear incendiary strand according to the present invention.

The present invention provides a linear incendiary strand and a method for setting fire to vegetative matter over the surface of an area of land. In general, the linear incendiary strand of the present invention may be embodied in a number of different strand-like physical forms, such as, for example, a tape, ribbon, cord, tube, or filament. The selected shape of the device is not critical to fulfilling the central objects of the invention.

The strand is constructed of solid or semi-solid materials, and must possess a degree of physical flexibility to allow for it being wound upon a spool of suitable diameter for handheld deployment by a person walking through an area to be burned. For example, the strand may require sufficient bending flexibility to be radially wound about a spool with a core size of approximately three inches in diameter, and the deployed strand should not tend to retain the circular shape of the spool upon which it was wound. Other means of strand deployment are contemplated, such as by motorized vehicle or by helicopter; however, the requirement for flexibility is still important. The incendiary strand may also be provided to users in the form of a loose coil in a box, bag, drum or other suitable container. The physical size of the strand is selected to meet the same criteria for deployability, and at the same time must allow for a sufficient quantity of component materials to achieve desired burning qualities.

The linear incendiary strand of the present invention is further provided with reinforcing means that provides a degree of longitudinal tensile strength to prevent separation while being pulled during deployment. Longitudinal reinforcing means may be provided by the inclusion of fibrous elements in the overall structure of the strand, such as an exterior sheath, a continuous textile substrate, or as elongate fiber particles in a structural composite matrix.

The strand may further be provided with means for fragmentation of the strand subsequent to ignition, allowing the body of the strand to become separated into individually burning segments. These segments, which may be, for example, approximately six inches in length, will fall and provide for the ignition of combustible materials at the ground surface if the strand is suspended by branches or other obstacles. Fragmentation means may be provided by the accelerated burning of longitudinal reinforcing elements at selectively spaced intervals along the strand. Specifically, the longitudinal and lateral gas channels are subject to intense heat produced by the burning of a pyrotechnic element contained within the strand. The intense, concentrated heat results in accelerated decomposition of the strand body along those channels, causing the strand to separate into fragments. Alternatively, fragmentation may also be provided by the softening, or melting, of certain structural elements of the strand, allowing the strand to undergo physical transformation during burning from a solid strand to indistinct globules of burning fuel, which may drip to ground and ignite surface fuels.

An important advantage of the incendiary device of the present invention over prior art methods for igniting prescribed burns is the ability to deploy, or lay out, the subject linear incendiary strand throughout the area to be burned prior to the commencement of burning operations. The incendiary strand of the present invention is provided with weatherproofing features that enable the material to be exposed to ambient weather conditions for an extended period of time before it is ignited, without detrimental effects upon its performance. Weatherproofing features may include the incorporation of water-resistant coatings and compositions in the manufacture of the strand; such coatings or compositions provide a water vapor barrier for other components of the strand that may be hygroscopic in nature.

The linear incendiary strand of the present invention incorporates rapid axial ignition means for initiating combustion of a fuel component, wherein an ignition reaction is conducted rapidly along the longitudinal axis of the strand. Such ignition reaction is characterized as a flame-producing, non-explosive deflagration, and does not exhibit the brisance or linear rate of burning that is characterized as a detonation. The rapid axial ignition means is exemplified by an elongate pyrotechnic element that, upon ignition, burns in a rapid manner producing hot gasses and incandescent particles capable of igniting the co-linearly arranged combustible fuel component of the incendiary strand. Such rapid propagation of an ignition reaction and subsequent ignition of the fuel component may provide a nearly instantaneous line of fire along the path of the subject incendiary device. The term "rapid", as used herein and in the claims, describes an accelerated rate of ignition propagation axially along the body of the ignition strand, relative to the intrinsic rate at which free-burning combustion of assembled strand materials propagates along the strand, upon ignition from an external heat source.

One means of providing rapid axial ignition along the incendiary strand, although not exclusive of other alternatives, is the incorporation of a "piped fuse" structure in the body of the strand. The technology of piped fuses is known in the art of pyrotechnics, described for example in "Military and Civilian Pyrotechnics" (Ellern, 1968). The piped fuse, also known as "quick match" or "piped match" to those practiced in the art, is characterized as an elongate pyrotechnic element, such as a fuse, that is confined within the interior of an elongate close-fitting conduit. This conduit, normally serving the purpose of an exterior sheath of the fuse assembly, provides a channel for gaseous combustion products and heat to be driven in a forward direction along the length of the fuse. The hot gasses and sparks pre-heat and ignite the pyrotechnic element in advance of the traveling wave of ignition reaction, further accelerating the flame front to high linear velocity along the longitudinal axis of the fuse assembly. The present invention may incorporate such a piped match structure in the construction of the strand, whereby a pyrotechnic element is arranged centrally in a channel defined by other structural elements of the strand. At least some proportion, preferably a major proportion, of the interior surface area of the longitudinal gas channel of the strand is comprised of a solid or semi-solid fuel component, which upon ignition will undergo self-sustained combustion and emit flames to the exterior surface of the strand. The gas channel may further be formed by a suitable exterior covering, or sheath, such as, for example, paper, plastic film, or coated fabric compositions.

The pyrotechnic element of the rapid axial ignition means of the present invention may be selected from a number of alternatives known in the art, including, but not limited to, deflagration cord, quick match, black match, safety fuse, igniter cord, and powder train. The element is provided in elongate form, and may be, for example, an extruded strand formed from a mixture of an oxidizing agent, a fuel compound and an appropriate binder. A preferred pyrotechnic element is comprised of a cellulose fiber substrate that is impregnated and coated with a composition comprised of oxidizer and fuel compounds. The cellulose fiber substrate may be paper, or preferably, a loose woven cotton textile fabric. The pyrotechnic composition coated onto the cellulose fiber substrate is selected from chemical combinations known in the art that provide a high heat of combustion, produce hot gasses, and eject incandescent particles (sparks) during thermal decomposition. Such pyrotechnic mixtures are typically used in display fireworks, and may also function as solid rocket propellants. For example, a suitable mixture is comprised of ammonium perchlorate (30% by weight), potassium perchlorate (30% by weight), powdered aluminum, 325 mesh (25% by weight) and binder (15% by weight).

As is known in the art, the pyrotechnic components may be mixed together with a suitable binder that maintains the reactive chemicals in a homogenous admixture, provides adhesion to the cellulose fiber substrate, and provides a barrier to atmospheric or liquid water that otherwise may cause degradation of reactive performance. The binder, which may also provide additional fuel for the ignition reaction, must be selected to provide the pyrotechnic composition with adequate flexibility when incorporated into the overall incendiary strand structure. Suitable binders include, for example, plasticized cellulosics such as cellulose nitrate and cellulose acetate, polyacrylate, elastomers such as poly-isoprene and poly-butadiene, and polyolefins such as polyethylene and polypropylene. A preferred binder is cellulose acetate butyrate, which provides exceptional water resistance and is derived from renewable resources.

The cellulose fiber substrate is coated with the pyrotechnic composition using techniques commonly known in the art of fabric and paper coating. Examples of such techniques are roll coating, immersion coating, and spray coating. The coated cellulose fiber substrate, which may be provided as a wide or narrow web in a continuous, indeterminate length, may then be slit into narrower widths of suitable dimension for manufacture of the incendiary strand.

A solid or semi-solid fuel component comprises a major proportion, by weight, of the body of the present incendiary strand. The fuel component is selected from known combustible substances, or mixtures of substances, that undergo self-sustained combustion in a manner in which flames are produced of suitable length and intensity to cause the ignition of nearby vegetative fuels. Further, the amount of fuel component, as distributed along the length of the strand, must be sufficient to sustain burning at any point along the strand for a period of time sufficient to raise the temperature of nearby vegetative matter to the point of ignition. Some dead woody fuels may possess a relatively high degree of bound cellular moisture, requiring a certain intensity and duration of incident heat energy before the water is driven off to a point where burning of the vegetative matter can ensue in a self-sustained process. The incendiary strand of the present invention is provided with a fuel component that exhibits flaming combustion for a duration of from ten seconds to five minutes in time, as measured at any point along the length of the strand.

Suitable solid or semi-solid combustible substances for the fuel component are widely known in the art of fire-starting devices. In general, a composition is selected that is capable of being formed into a strand, such as by extrusion, coating onto a substrate carrier, or by encasement of a granular form of the composition in a suitable sheath. As described earlier, the fuel composition must possess a sufficient degree of flexibility, and must not fracture as the strand is twisted and bent. Possible alternatives for the fuel component include waxes, tars, natural resins, latex rubbers, gelled hydrocarbons, polyethylene, polypropylene, poly-isoprene, poly-butadiene, and silicon rubber. Certain cellulose fibers such as sawdust, wood pulp, cotton linters and ground vegetative matter may be incorporated into the selected fuel composition to act as a filler and to provide structural reinforcement, additional fuel, and resiliency. Since it is an objective of the present invention to replace the petroleum based products now used in controlled burning operations, it is desired to select a fuel component that is derived from renewable resources. A preferred fuel component is a composition based on resinous products from conifer trees. In particular, the higher boiling point fractions of conifer extractives provide suitable caloric heat output during combustion, and possess a degree of thermoplasticity that is advantageous for production of an incendiary strand as contemplated in the present invention. The conifer tree resins may be obtained commercially from, for example, pine stump distillation or extraction, collection of live tree exudates, or tall oil produced by the pulp and papermaking processes. A further description of the preferred resin-based fuel composition and the process used to produce it is provided in the examples below.

The present invention includes a method of igniting vegetative matter over an area of land using a solid, flexible, elongate incendiary strand as described above. In general, the vegetative matter referred to herein may be defined as combustible plant material desirous of being consumed by burning, and may include logging slash, down and dead woody materials, leaves, conifer needles, brush, grasses, weeds, and agricultural residues. The present invention is particularly well suited for use in prescribed burning activities on forested lands to accomplish natural fuels reduction, wildlife habitat improvement, and logging slash disposal. In addition to the above listed land management applications, the incendiary strand may also provide an improved means for igniting backfires and burnouts during wildfire control operations.

Figure 5:
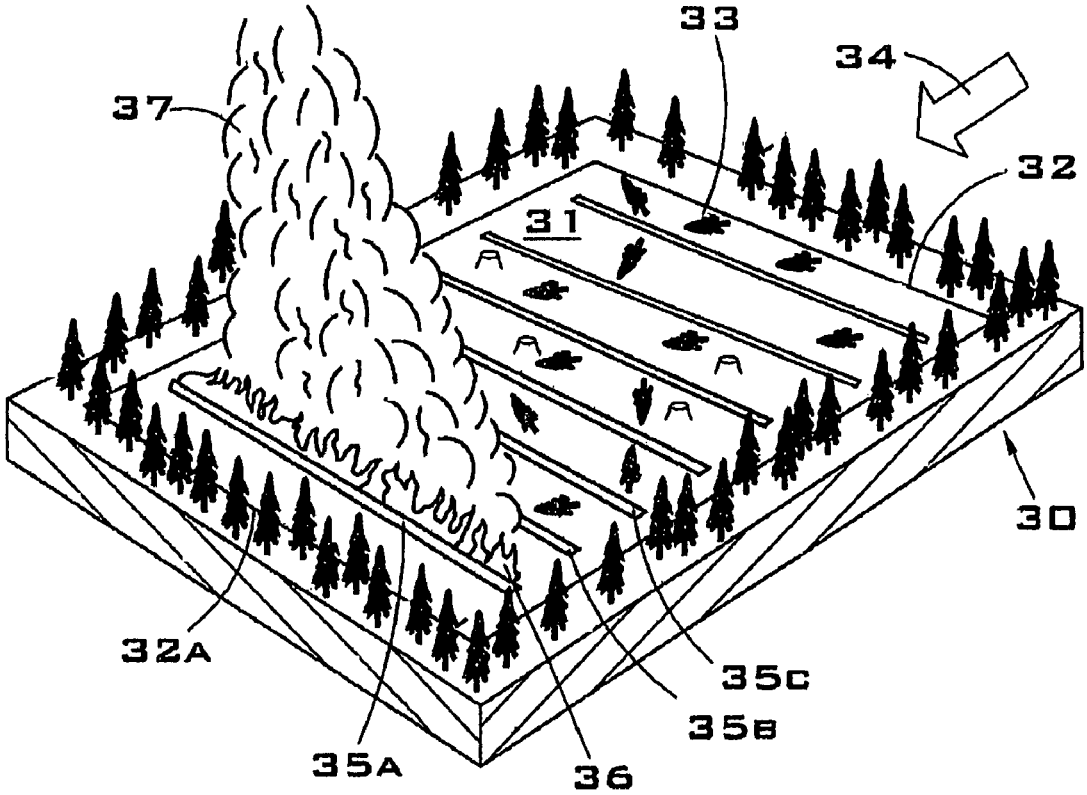
FIG. 5 is an isometric view of an area of land whereupon the linear incendiary strand of the present invention is shown to be placed for purposes of illustrating a method of ignition according to the present invention.

A significant improvement of the present invention over previous methods of igniting controlled fires is the ability provided to deploy the means of ignition before actual burning operations commence, thereby reducing the number of personnel required during the burn. The linear incendiary strand may be deployed, or laid out, in predetermined patterns throughout the area to be burned in accordance with known practices to achieve desired fire behavior. When a "Strip-Head" firing pattern (as shown in FIG. 5) is desired, the incendiary strand will be placed along nearly parallel pathways across the area to be burned in such a manner as to provide a desired level of fire intensity and rate of spread. Alternatively, a circular ignition pattern may be selected for conducting a "mass ignition" of a large area, wherein the strand would be placed in concentric circles of incrementally increasing diameter. The distance between adjacent pathways, or strips, is determined in part by the amount and type of combustible materials, the slope of the area, and the favorable wind direction for the safe conduct of the burn.

The incendiary strand may be deployed by personnel walking along the intended ignition strips, or may similarly be deployed by vehicular or aerial means. The incendiary device may be provided as a continuous strand of indeterminate length wound upon a spool of appropriate size for the means of deployment. For manual application, a spool size that would allow for a person to walk over difficult terrain with a rotary unspooling apparatus is desired. A larger sized spool may be appropriate for vehicular or aerial deployment, and may require powered unspooling.

Each of the several individual lengths of incendiary strand are ignited in succession, at intervals of time selected to achieve desired fire behavior characteristics. The strands may be ignited by the direct application of flame to an exposed surface of the pyrotechnic element of the strand. The strand may be ignited at a cut end, or at any location along the strand where a portion of the pyrotechnic element has been exposed by removal of outer materials. A distinct advantage of the present invention is the ability to alternatively initiate strand combustion by electrical means, using, for example, squibs or what are known as "electric matches" in the pyrotechnics field. Electric matches are often used to ignite lifting charges for aerial fireworks, and they operate by the electrical resistance heating of a wire element, which causes a surrounding bead of pyrogenic compound to ignite. An electric match may be inserted into an opening of the subject incendiary strand and will cause the strand to ignite upon electrical activation. The electrical apparatus selected for such initiation of the strand is not a subject of the present invention, as a number of suitable ignition systems are known in the art of blasting or pyrotechnics. Remote electrical ignition of the incendiary strand provides a higher degree of safety for personnel conducting controlled burns, and it also affords a means to ignite successive burn strips rapidly when a sustained high intensity fire is desired.

The improved ignition method of the present invention may also be suitably employed in the setting of backfires, or burn-outs, in wildfire control activities. A linear incendiary strand, as described, may be placed among combustible vegetative matter adjacent to fire control lines in the path of an advancing wildfire. The fire control lines may, for example, be for the purpose of protecting houses, groups of houses, or resources of special concern from destruction by the wildfire. Additional ignition strands may also be placed along strips parallel in orientation to the first strip, at a distance of spacing between strips determined accordingly for fuel, weather and topographical conditions. The individual incendiary strands may then be ignited in an appropriately timed sequence whereby a line of fire is drawn from the control line outwardly towards the advancing wildfire, and against the direction of the prevailing winds. Through the use of radio-signal-activated, electrical ignition apparatus, personnel may be afforded the ability to conduct such an operation remotely and from a safe distance from the fire's path. The effectiveness of the above-described method is further enhanced when the incendiary strands are ignited precisely at the onset of indraft winds generated from the advancing wildfire.

EXAMPLE NO. 1

Figure 2:
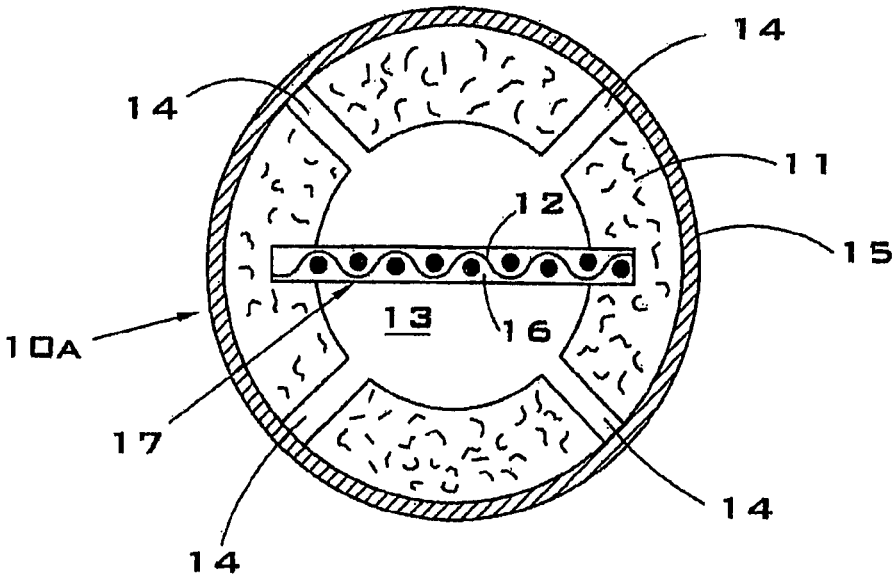
FIG. 2 is a cross-sectional view taken along line 2-2 in FIG. 1.

Referring now to FIG. 1 and FIG. 2, a specific embodiment of the present invention is shown as having the physical form of an elongate cord-like structure of indeterminate length. FIG. 1 illustrates a fragmentary isometric view of a linear incendiary strand; FIG. 2 shows a cross-sectional view of the same strand taken along line 2-2 of FIG. 1. The incendiary strand 10*a* has a tubular body 11; the outside diameter of such strand is preferably about ¾ inch (1.9 cm). The central longitudinal duct of strand 10*a* forms a gas channel 13, having an inside diameter of about ¼ inch (0.64 cm). Pyrotechnic element 17, comprised of fabric substrate 12 with a coating of pyrotechnic composition 16, is disposed centrally within gas channel 13, with its lateral edges fixedly embedded in fuel composition 11 along the longitudinal axis of strand 10*a*. A plurality of vent passages 14 are radially disposed about the circumference of strand 10*a* to form a grouping; such vent passage groupings are arranged at equidistant intervals along the strand. Outer waterproofing layer 15 covers the exterior surface of strand 10*a*, including the outer opening of the vent passages 14.

Pyrotechnic element 17 is produced by first soaking fabric substrate 12 in a saturated aqueous solution of a water-soluble oxidizing agent, preferably ammonium perchlorate or potassium nitrate. A preferred fabric is bleached cotton cheesecloth that has a denier of around 60 threads per inch, and is supplied in rolls of about 16 inches wide. This material is highly absorbent, has relatively strong tensile strength, and has open interstitial voids, which may be filled with a pyrotechnic composition during the coating process. The fabric is then squeezed out to remove excess solution and dried in a warm air drying tunnel, leaving the cotton threads of the fabric impregnated with oxidizing agent.

The impregnated cotton fabric is coated with a rapidly burning pyrotechnic composition 16 using processes typically used in the fabric coating trade, such as, for example, a process utilizing an immersion coating line. The pyrotechnic composition is comprised of ammonium perchlorate (30% by weight), potassium perchlorate (30% by weight), powdered aluminum, 325 mesh (25% by weight) and a liquid binder (15% by weight). A suitable binder is prepared by dissolving nitrocellulose solids (12% nitrogen content) in acetone, in proportions to achieve a viscous heavy-bodied solution. The coated fabric is dried, and then rotary slit into strips approximately ½ inch (1.27 cm) in width and rewound onto suitable spools.

The fuel composition 11 is comprised of a combustible thermoplastic resin in homogenous admixture with cellulose fiber particles that have been impregnated with an oxidizing agent. The thermoplastic resin is preferably a mixture of a pine resin derivative (80% by weight), cellulose acetate butyrate (15% by weight), and a plasticizing agent (5% by weight). A suitable pine resin derivative that is commercially available is VINSOL resin, manufactured by Hercules Inc., which is produced from the steam distillation of pinewood stumps. A suitable plasticizing agent is selected from the group of plasticizers that are compatible with cellulosic and rosin-based products, and provides the incendiary strand with adequate flexibility. A preferred, vegetable-based plasticizer is glyceryl triacetate, available commercially as TRIACETIN, from Eastman Chemical Company. Other suitable plasticizers include triethyl citrate (CITROFLEX 2, from Morflex, Inc.) and butyl ricinoleate (FLEXRICIN P-3, from CasChem, Inc.). The ingredients are mixed together at a temperature of about 200 degrees C. to form a homogenous thermoplastic composition.

A cellulose fiber filler material is selected to provide reinforcing strength to the incendiary strand and to provide additional fuel for combustion. A preferred fibrous material is finely divided sawdust. Specifically, sawdust derived from the western red cedar tree is easily pulverized into individual fibers having a large length-to-width ratio. Further, this fibrous filler material derived from cedar wood or bark is light in weight, provides a high heat of combustion, and readily absorbs certain liquids.

The cedar fibers are first soaked in a saturated aqueous solution of a water-soluble oxidizing agent, such as potassium nitrate or ammonium perchlorate, and then dried, in order to provide additional oxygen for combustion of the incendiary strand. This oxidizer-enhanced cedar fiber is then added to the hot resin composition in proportions to achieve a thermoplastic composite having a thick, dough-like consistency at a processing temperature of around 150 degrees C. Care must be exercised to ensure that the processing temperature of the composition does not approach the decomposition temperature of the oxidizing agent used.

The fuel composition 11 is formed into the shape of a hollow tube, having embedded within a portion of its interior walls the pyrotechnic element, using a cross-head extrusion technique. This extrusion process is similar to that used in the plastics industry to form thermoplastic layers over elongate strands, such as in the application of plastic insulation to electrical wires. The incendiary strand 10*a* is formed by feeding pyrotechnic element 17 through a slotted aperture centrally disposed within a specifically designed extrusion head, while fuel composition 11 is forced under pressure through the head. In this manner, a continuous strand is formed, and the strand is then cooled to solidify the thermoplastic composition. The extrusion apparatus may be a single or double screw extruder, and it is set up in a manner in which external heat is provided to melt the thermoplastic material instead of using adiabatic heating through high pressure compression.

The cooled incendiary strand is then subjected to a perforating or drilling operation whereby vent passages 14 are produced around the circumference of the strand, at incremental distances of about 6 inches (15.2 cm) along its longitudinal axis. Outer waterproofing layer 15 may be applied by passing the strand quickly through an immersion bath of a melted thermoplastic polymer, such as plasticized cellulose acetate butyrate, and rapidly cooled using a coolant bath. Alternatively, outer waterproofing layer 15 may be applied by the spiral wrapping of an adhesive-backed cellulose acetate film about the strand's outer surface.

The incendiary strand 10*a* is ignited by the application of flame to pyrotechnic element 17. The ignition reaction consumes pyrotechnic composition 16 at a relatively slow linear rate initially, discharging a high proportion of gaseous products of combustion away from the strand. As hot gasses are forced into gas channel 13, the ignition reaction accelerates to a high velocity of propagation along the surface of pyrotechnic element 17 due to the projection of heat forward along the gas channel 13. The ignition reaction further initiates combustion of fuel composition 11 along the internal surface of gas channel 13, which burns readily due to the incorporation of the oxygen-providing agent in the fibrous filler. The heat of combustion produces elevated internal strand pressure sufficient to burst outer waterproofing layer 15 at the outer terminus of the vent passages 14, allowing flames and sparks to emit therefrom. As the strand burns internally, the heat generated softens and melts fuel composition 11, most noticeably in the area of the vent passages 14. The strand's structural integrity fails first at these locations, causing the strand to separate into individually burning pieces, which may then fall to the ground if they happen to be elevated. The strand, or the pieces of the strand, continue(s) to burn after transitioning into an amorphous melt, for a period of up to five minutes and with flame lengths of about 4 inches (10.2 cm).

EXAMPLE NO. 2

Figure 3:
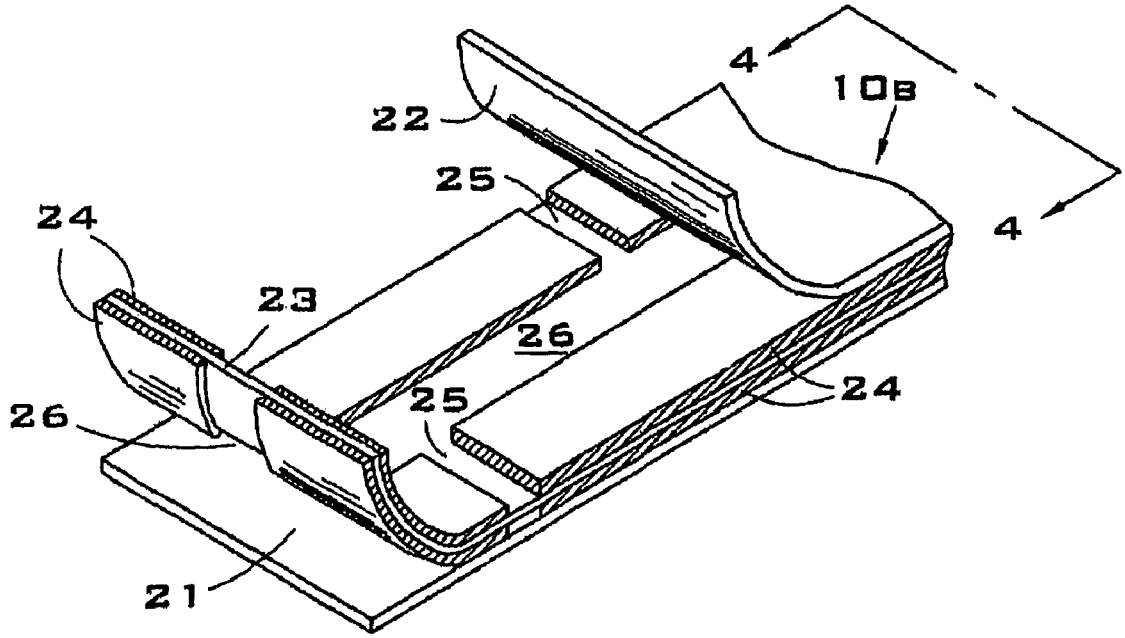
FIG. 3 is a fragmentary isometric view of a tape-like embodiment of a linear incendiary strand according to the present invention. The several layers of the tape are shown to be peeled upwardly away from the base layer of the tape for illustrative purposes only.
Figure 4:
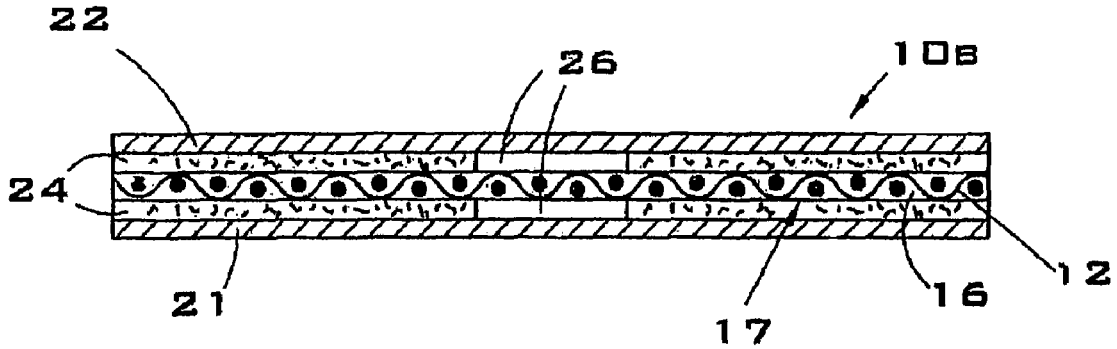
FIG. 4 is a cross-sectional view taken along line 4-4 in FIG. 3.

In an alternative embodiment, the incendiary device of the present invention is shown in FIG. 3 and FIG. 4 as having the physical form of a wide tape, or ribbon, of indeterminate length. FIG. 3 illustrates a fragmentary isometric view of a linear incendiary strand 10*b* of such structure, herein referred to as an incendiary tape; FIG. 4 shows a cross-sectional view of the same strand, taken along line 4-4 of FIG. 3. The incendiary tape 10*b* is produced as a lamination of multiple layers, comprising upper covering layer 22, lower covering layer 21, fuel composition 24 and pyrotechnic element 23. Fuel composition 24 is present in a discontinuous pattern on both upper and lower surfaces of pyrotechnic element 23, forming central longitudinal gas channel 26 in connective arrangement with multiple lateral gas channels 25. Lateral gas channels 25 are open to the exterior lateral edges of tape 10*b*, and are longitudinally offset to either side of longitudinal gas channel 26.

Pyrotechnic element 23 is produced using the same materials and in the same manner as described for pyrotechnic element 17 of the previous example. The only difference between the two examples is the width to which pyrotechnic element 23 of the present example is to be slit, which is about 5 inches (12.7 cm).

Fuel composition 24 is produced using the same combustible resin composition as described for fuel composition 11 of the previous example; however, the cellulose fiber filler material is excluded from the present example.

Upper covering layer 22 and lower covering layer 21 provide a water barrier and protective covering for fuel composition 24 and pyrotechnic element 23. In addition, the inner surfaces of covering layers 22 and 21 provide envelopment for channeling hot gasses produced by combustion of pyrotechnic element 23, specifically along longitudinal gas channel 26 and lateral gas channels 25. The material selected for upper and lower covering layers 22, 21 may be polymeric film, coated fabric, or paper. A preferred material is 30 lb. creped kraft paper, which provides suitable flexibility for winding the incendiary tape 10*b* radially about a spool core. Creping allows the outer surface to stretch slightly, and the inner surface to compress slightly without damaging the functional integrity of the covering.

The creped kraft paper is impregnated with an oxidizing agent to enhance its burning characteristics. In a process similar to that used for impregnating fabric substrate 12 of pyrotechnic element 17, the paper is first soaked in a saturated aqueous solution of an oxidizing agent such as ammonium perchlorate or potassium nitrate, and then dried. Preferably, this oxidizing agent treatment is performed concurrently with the wet creping process used to produce the creped paper. The dried paper is subsequently impregnated and coated with a waterproofing agent through an immersion and drying process known in the papermaking industry to produce coated paper. The waterproofing agent is preferably a cellulose acetate butyrate lacquer; however, microcrystalline wax solutions are also suitable provided they are non-petroleum based. The creped kraft paper, treated as described, is slit to 5 inch (12.7 cm) widths and wound upon spools.

The separate layers of incendiary tape 10*b* are combined together to form a permanent lamination in a process typically utilized in the tape converting trade. Spools of upper covering layer 22 and lower covering layer 21 are mounted on separate feed spindles of a roll laminating apparatus. A spool of pyrotechnic element 23 is similarly mounted on a feed spindle between the spools of upper and lower covering layers. Pyrotechnic element 23 is drawn through a double-sided slot-die extrusion apparatus comprising two separate slot die extrusion heads on each side of the pyrotechnic element. The individual extrusion heads are provided with electrical or pneumatically operated shut-off valves, and the heads are arranged to apply two separated strips of the heated thermoplastic fuel composition 24 to each side of pyrotechnic element 23. Coating thickness is about 20 mils (0.020 inch) per side. The flow from each extrusion head is modulated by linear indexing means to provide discontinuous strips longitudinally. The resultant areas of pyrotechnic element 23, devoid of fuel composition 24 on both sides, form lateral gas channels 25.

Upper and lower covering layers 21, 22 are drawn together with the coated pyrotechnic element 23 and fed through suitably spaced pressure rollers to form a permanent lamination having a total thickness of about 0.060 inch (60 mils). Fuel composition 24 has superior adhesive qualities and is similar in form to commercially available hot melt glues. As such, the thermoplastic fuel composition 24 is heated and driven under pressure to the heated extrusion heads in a similar fashion as other hot melt coatings.

In operation, incendiary tape 10*b* is ignited by direct flame contact with pyrotechnic element 23, the combustion of which is similar to that described in the previous example. The ignition reaction propagates rapidly along longitudinal gas channel 26, and subsequently along each lateral gas channel 25, which results in a discharge of flames and sparks from points along the edges of the tape. In a very short time after ignition, the heat generated by the combustion of pyrotechnic composition 16 is sufficient to burn through upper and lower covering layers 21, 22, as well as fabric substrate 12, causing the tape 10*b* to separate into individually burning pieces. Although pyrotechnic composition 16 is present throughout the entire pyrotechnic element 23, it does not burn rapidly where it is sandwiched between layers of fuel composition 24.

The manufacturing process described is based upon producing a single continuous strand 5 inches (12.7 cm) wide and of a length limited by practical roll lengths of the component materials. A wide web process may also be utilized to produce the incendiary tape, whereby wide width materials and machinery are used to produce a master roll, which is then slit into multiple rolls of tape having a width of about 5 inches (12.7 cm) each. Such a process may afford much greater efficiencies of production.

EXAMPLE NO. 3

The ignition method of the present invention is suitably adapted for use in conducting a type of controlled burn that is known in the art as High Energy or Mass Ignition burning. This type of burning may be used to mitigate air pollution concerns by creating a fire of high enough intensity to generate strong convective transport of smoke vertically, resulting in the dilution and dispersion of particulate emissions from a fire. (Ottmar et. al., 2001). In addition, it may also be desirable to generate sufficient heat energy over the fire to enable the smoke column to reach the lifting condensation level of the atmosphere, where cloud scavenging of smoke may substantially reduce particulate levels (Radke et al., 1991). A fire-generated convection column that has a greater measure of vertical kinetic energy than that presented horizontally by atmospheric winds will tend to rise directly upward for a distance above the fire, allowing gasses and embers to cool. A weak smoke column will be tilted over by ambient winds, or may adhere to the hillside directly over a burn area, often leading to fire escape across established fire lines by the transport of hot gasses and sparks. High energy burning has been practiced in the past most effectively using aerial ignition methods, as rapid ignition and a sustained rate of fire spread is required to maintain sufficient fire intensity (McCrea, 1996).

Referring now to FIG. 5, a method of igniting vegetative matter according to the present invention will be described with reference to its use on an area of forested land that has been logged, generally designated at 30. The area of land to be burned 31 is defined by outer boundaries 32, and has upon its ground surface forest litter, naturally occurring surface vegetation, and logging slash 33, which shall herein be referred to in the aggregate as "fuels." For the purposes of this example, it is assumed that there exists in area 31 approximately 2.5 kg of dead and dry fuels 33 available for burning per square meter of surface area. The wind direction is indicated by arrow 34, and is assumed to have a velocity of six meters per second. Multiple separate lengths of a solid, flexible incendiary strand, as described earlier, are representatively shown along intended burn strips (35*a*, 35*b*, 35*c*); in this example, the strips are spaced approximately 20 meters apart.

As is common practice in the art, fire is first set to fuels lying adjacent to the downwind boundary 32*a*, and a backing fire is allowed to burn slowly into the direction from which the wind is blowing. This backing fire is not shown in the present drawing for purposes of illustrative clarity; however, its purpose is to consume fuels near the boundary to help prevent unwanted downwind fire spread across control lines. During this period of relatively low intensity burning, smoke column 37 is generally tilted over by the ambient wind, transporting smoke and ash particles directly across downwind boundary 32*a*. The linear incendiary strand lying along the first interior burn strip 35*a* is ignited as soon as the backing fire has spread a sufficient distance away from the downwind boundary 32*a* to provide a reasonably safe buffer strip devoid of unburned fuels. The strand may be ignited, for example, by direct flame contact from friction matches, a handheld lighter, a torch, or by remote electrical means. The incendiary strand ignites nearly instantaneously along its entire length, and flames emitting from the strand subsequently ignite adjacent fuels 33. The resulting line of fire spreads through unburned fuel in the direction of the wind, creating indrafts that draw the backing fire toward it. The interaction of the two parallel lines of fire may generate a significant level of fire intensity between them, resulting in an increase in convective energy over the fire. In accordance with known fire behavior principles, the previously tilted smoke column 37 will tend to rise to a vertical orientation when the (kinetic) power of the fire is greater than the (kinetic) power of the wind (Nelson, 2003), a criteria which is dependent upon fire intensity and wind speed. For the given amount of fuels and given wind velocity assumed in this example, a sustained fire rate of spread greater than 0.08 meters per second (16 feet per minute) is necessary to develop and maintain a strong vertical smoke column (Radke et. al., 1991). In practice, rate of spread requirements will vary depending on actual fuel characteristics such as moisture content, arrangement, and particle size, as well as weather factors such as temperature and humidity.

The second strip, and each successive strip thereafter, is caused to be ignited at intervals of approximately five minutes each, based on the 20-meter spacing between strips and the desired 0.08 meters per second rate of spread. The rapid ignition characteristics provided by the present incendiary strand support this accelerated rate of burning, a rate which is needed in order to maintain the desired level of fire intensity and resultant smoke column strength. If this level of burning is allowed to decrease, the ambient wind 34 may force the smoke column 37 to tilt over toward the downwind boundary 32*a*. The tilted column may result in undesirable low-level smoke transport to sensitive downwind areas and the possibility of an escaped fire due to hot embers falling out of the column onto unburned forest fuels. This process of strip ignition is continued progressively along the length of the area to be burned, until all fuels have been consumed.

The present invention has a number of important features and advantages. It provides a means to initiate a nearly instantaneous line of fire in combustible materials over a ground surface, allowing for a greater ability to manipulate and control fire behavior. Ignition of prescribed fires using the present incendiary strand does not require personnel to be located in hazardous areas of unburned fuels with fire nearby, as is now the case when fires are ignited using handheld drip torches. Burning operations may be conducted under conditions which may otherwise restrict the use of fire, due to smoke dispersal problems or high fuel moisture. More effective backfiring operations may be conducted to limit the spread of destructive wildfires, by igniting backfires at the onset of an approaching fire's indraft without putting personnel at risk. The present invention also offers an alternative to petroleum-based ignition methods by utilizing materials obtained from renewable resources.

Although only certain preferred embodiments of the present invention have been shown and described, it will be apparent to those skilled in the art that many changes and modifications may be made without departing from the invention in its broader aspects. The appended claims are therefore intended to cover all such changes and modifications as fall within the true spirit and scope of the invention.

DEFINITIONS

The term "adiabatic" means of, relating to, or being a reversible thermodynamic process that occurs without gain or loss of heat and without a change in entropy.

The term "brisance" means the shattering effect of the sudden release of energy in an explosion.

The term "deflagrate" means to burn or cause to burn with great heat and intense light.

The term "hygroscopic" means readily absorbing moisture, as from the atmosphere.

The phrase "nearly instantaneous" is used to describe a rapid rate of flame propagation along a linear pathway for the purpose of initiating fires in vegetative fuels.

The term "squib" refers to a small tube or block that contains a small quantity of ignition compound in contact with a wire bridge heating element.

REFERENCES

Ellern, H., 1968. Military and Civilian Pyrotechnics. Chemical Publishing Co. Inc., New York, N.Y.

McRae, D. J. 1996. Prescribed Fire Aerial Ignition Strategies. Northern Ontario Development Agreement; Technical Report TR-33.

Ottmar, R. D., J. L. Peterson, B. Leenhouts and J. E. Core. 2001. Smoke Management Techniques to Reduce or Redistribute Emissions, p. 141-162 in Smoke Management Guide for Prescribed and Wildland Fire, 2001 Edition. National Wildfire Coordinating Group, pub. #NFES-1279.

Nelson, R. M., Jr. 2003. Power of the Fire—A Thermodynamic Analysis. International Journal of Wildland Fire, 12, 51-65.

Radke, L. F., and D. E. Ward. 1991. Prescriptions for Biomass Fire Smoke Reductions in Proceedings, 11th Conference on Fire and Forest Meteorology; Apr. 16-19, 1991; Missoula, Mont.: 460-469.

I claim:

1. A rapidly igniting, prolonged burning incendiary strand for setting fire to combustible materials over an area of land, comprising:

a flexible strand body of indeterminate length, comprising a plurality of co-linearly arranged and connectively assembled components forming a contiguous cross-sectional shape selected from the group consisting of tape, strip, ribbon, tube, filament, rope and cord, and;

at least one elongate pyrotechnic element, linearly arranged along the longitudinal axis of the strand body, for conducting an ignitive reaction at a predetermined rate of axial propogation along the strand, the pyrotechnic element including a deflagrative composition comprised of one or more oxidizing agents and one or more first combustible fuel compounds, and;

one or more bodies of a solid or semi-solid second combustible fuel component distributed along the longitudinal axis of the strand body, in connective arrangement with said pyrotechnic element, whereby said second combustible fuel component bodies are operable when ignited to undergo self-sustained, air-oxygenated combustion, emitting flames from the exterior surface of the strand, and;

strand fragmentation means for separation of the strand body into separate burning segments, subsequent to ignition, and;

whereby the pyrotechnic element, upon operative ignition from an external heat source, conducts an ignitive signal rapidly along the length of the incediary strand, progressively initiating self-sustained combustion of the second combustible fuel component bodies, and thereby providing flame generation concurrently along the entirety of the strand body to kindle combustible materials proximate to the incediary strand.

2. The incendiary strand of claim 1, wherein the elongate pyrotechnic element is confined within the interior of an elongate close-fitting conduit.

3. The incendiary strand of claim 1, wherein the elongate pyrotechnic element is arranged centrally in a channel defined by other structural elements of the strand.

4. The incendiary strand of claim 1, wherein the second combustible fuel component comprises one or more planiform layers(s) of combustible thermoplastic resin, and wherein the second combustible fuel component and elongate pyrotechnic element are laminated between an upper covering layer and a lower covering layer to form a tape.

5. The incendiary strand of claim 4, wherein the second combustible fuel component layer is in a discontinuous pattern forming a central longitudinal gas channel in connective arrangement with multiple lateral gas channels.

6. The incendiary strand of claim 5, wherein the lateral gas channels are open to the exterior lateral edges of the tape and are longitudinally offset to either side of the longitudinal gas channel.

7. The incendiary strand of claim 1, wherein the pyrotechnic element comprises a cellulose fiber substrate that is coated with said deflagrative composition.

8. The incendiary strand of claim 1, wherein the means for fragmentation of the strand subsequent to ignition comprises rapidly burning segments of the strand body placed at selective intervals along the strand.

9. The incendiary strand of claim 1, further comprising weatherproofing means for preventing infiltration of moisture into the strand body.

10. A method of igniting vegetative matter over an area of land using the incendiary strand of claim 1, comprising the steps of:

laying out one or more incendiary strand(s) in a predetermined pattern throughout the area to be burned; and igniting each incendiary strand in succession at intervals of time selected to achieve desired fire behavior characteristics.

11. The method of claim 10, further comprising the steps of:

placing multiple incendiary strands along strips in a predetermined spatial relationship to selected fire control lines, at a distance of spacing between strips that is determined according to fuel, weather and topographical conditions; and igniting the incendiary strands in a sequence timed to result in a line of fire being drawn in a desired direction of fire spread by convective and radiative influences of the multiple lines of fire initiated in the vegetative matter.

12. The incendiary strand of claim 1, wherein the second combustible fuel component is selected from the group of waxes, tars, natural resins, latex rubbers, gelled hydrocarbons, polyethylene, polypropylene, poly-isoprene, polybutadiene, and silicon rubber.

13. The incendiary strand of claim 12, wherein the second combustible fuel component is a natural resin composition comprising conifer tree resin.

14. The incendiary strand of claim 1, wherein the second combustible fuel component body, or bodies, provide flaming combustion for a duration of from ten seconds to five minutes, as measured at any point along the length of the strand.

15. A rapidly igniting, prolonged burning incendiary tape for setting fire to combustible materials over an area of land, comprising:

an elongate tape body of indeterminate length, comprising a plurality of co-linearly arranged component layers forming an adhesively bound lamination;

an upper covering layer and a lower covering layer of a material selected from the group consisting of polymeric film, coated fabric and paper;

at least one adhesive fuel composition layer arranged in a discontinuous pattern between the upper covering layer and lower covering layer, the pattern forming a central longitudinal gas channel in connective arrangement with multiple lateral gas channels open to the exterior lateral edges of the tape, and wherein the adhesive fuel composition is selected from the group consisting of waxes, tars, natural resins, latex rubbers, gelled hydrocarbons, thermoplastic polymers, and silicon rubber;

one or more elongate pyrotechnic elements arranged within the central longitudinal gas channel, wherein operatively, upon ignition from an external heat source, a combustive reaction is conducted along the pyrotechnic element at a predetermined rate of propagation, igniting the co-linearly arranged fuel composition through lateral heat transfer and projecting flames to the exterior of the tape through the lateral gas channels.

* * * * *